US008671825B2

(12) United States Patent
Funato

(10) Patent No.: US 8,671,825 B2
(45) Date of Patent: Mar. 18, 2014

(54) FLUID PRESSURE CYLINDER

(75) Inventor: Hiroshi Funato, Gifu (JP)

(73) Assignee: Kayaba Industry Co., Ltd., Tokyo (JP)

( * ) Notice: Subject to any disclaimer, the term of this patent is extended or adjusted under 35 U.S.C. 154(b) by 638 days.

(21) Appl. No.: 12/737,818

(22) PCT Filed: Jun. 7, 2010

(86) PCT No.: PCT/JP2010/059987
§ 371 (c)(1),
(2), (4) Date: Feb. 18, 2011

(87) PCT Pub. No.: WO2011/024537
PCT Pub. Date: Mar. 3, 2011

(65) Prior Publication Data

US 2011/0192278 A1 Aug. 11, 2011

(30) Foreign Application Priority Data

Aug. 27, 2009 (JP) ..... 2009-196541

(51) Int. Cl.
*F16J 15/22* (2006.01)
*F01B 11/02* (2006.01)

(52) U.S. Cl.
USPC ..... 92/165 R; 92/169.1

(58) Field of Classification Search
USPC ..... 92/169.1, 165 R; 91/462
See application file for complete search history.

(56) References Cited

U.S. PATENT DOCUMENTS

| | | | | |
|---|---|---|---|---|
| 2,090,826 | A | 8/1937 | Austin | |
| 4,909,130 | A | 3/1990 | LaBair | |
| 5,806,747 | A * | 9/1998 | Van Erden et al. | 227/10 |
| 6,044,752 | A * | 4/2000 | Harigaya | 92/163 |
| 7,353,748 | B2 * | 4/2008 | Sato et al. | 92/165 R |
| 2002/0170426 | A1 * | 11/2002 | Braatz | 92/165 R |
| 2008/0173169 | A1 * | 7/2008 | Ikari | 92/165 R |

FOREIGN PATENT DOCUMENTS

| | | | |
|---|---|---|---|
| CN | 101209650 | A | 7/2008 |
| JP | 59-006604 | A | 1/1984 |
| JP | 08-296611 | A | 11/1996 |
| JP | 09-151909 | A | 6/1997 |
| JP | 11-280709 | A | 10/1999 |

* cited by examiner

*Primary Examiner* — Edward Look
*Assistant Examiner* — Daniel Collins
(74) *Attorney, Agent, or Firm* — Rabin & Berdo, P.C.

(57) ABSTRACT

When a fluid pressure cylinder (1) is in a maximum expansion state, a piston (40) contacts a cylinder head (30). The cylinder head (30) is fixed to a cylinder tube (10) by a plurality of head bolts (12). The cylinder head (30) includes a pipe attachment seat (36), and the head bolts (12) are disposed in a first region (A) that avoids the pipe attachment seat (36). A non-contact portion in which contact is avoided between the piston (40) and the cylinder head (30) is formed in a second region (B) other than the first region (A), and therefore, when the fluid pressure cylinder (1) is in the maximum expansion state, a tensile load acting on the head bolts (12) on either side of the first region (A) can be suppressed to become equal to a tensile load acting on the other head bolts (12).

6 Claims, 3 Drawing Sheets

FLUID PRESSURE CYLINDER

FIELD OF THE INVENTION

This invention relates to a fixing structure for fixing a cylinder head to a fluid pressure cylinder that expands and contracts in accordance with a working fluid pressure.

BACKGROUND OF THE INVENTION

JP09-151909A, published by the Japan Patent Office in 1996, discloses a hydraulic cylinder in which a cylinder head is fixed to an open end of a cylinder tube by a plurality of head bolts.

The hydraulic cylinder expands and contracts when a working oil is supplied selectively through pipes to two oil chambers defined by a piston inside the cylinder tube from the outside. A pipe leading to one of the oil chambers is connected to the cylinder head via a joint. A pipe leading to the other oil chamber is connected to a base portion of the cylinder tube via a joint.

When the hydraulic cylinder reaches a maximum expansion state, the piston contacts the cylinder head, thereby preventing further expansion. In this state, the piston pushes the cylinder head, and as a result, a tensile load acts on the respective head bolts.

The bolts are screwed into screw holes that open onto an annular end surface of the cylinder tube. The working oil flowing between the pipe and the one of the oil chamber in the cylinder tube flows into the cylinder head via a port formed in a radial direction. A pipe attachment seat for fixing the joint is provided in the cylinder head on a periphery of an opening portion of the port. The head bolts are disposed to avoid the pipe attachment seat.

SUMMARY OF THE INVENTION

Hence, in this hydraulic cylinder, a region in which the head bolts for fixing the cylinder head to the cylinder tube are disposed and a region in which the head bolts are not disposed are formed in a circumferential direction.

When the hydraulic cylinder reaches the maximum expansion state, a tensile load is exerted on the head bolts by a pressure in the oil chamber for driving the hydraulic cylinder in an expansion direction. This tensile load is exerted in concentrated fashion on head bolts in the vicinity of a boundary between the region in which the head bolts are disposed and the region in which the head bolts are not disposed.

To respond to this load bias among the head bolts, great rigidity is required of the head bolts on which the tensile load is concentrated and a load bearing portion of the cylinder head for bearing the load. As a result, the size of the cylinder head increases.

It is therefore an object of this invention to equalize a tensile load acting on head bolts of a fluid pressure cylinder.

To achieve this object, this invention is a fluid pressure cylinder comprising: a cylinder tube having a central axis and an open end oriented in a central axis direction; a piston accommodated in the cylinder tube to be capable of sliding in an axial direction; a piston rod that is joined to the piston and projects from the cylinder tube in the axial direction to an outer side of the cylinder tube; a cylinder head that closes the open end while supporting the piston rod to be capable of sliding; and a plurality of head bolts that penetrate the cylinder head in the central axis direction in order to fix the cylinder head to the open end of the cylinder tube. The piston contacts the cylinder head in accordance with an axial direction displacement thereof.

The head bolts are disposed at equal angular intervals within a fixed angular range on a circumference centering on the central axis of the cylinder tube, thereby forming a head bolt group.

When an angular range in which the head bolt group, which is bordered by two straight lines linking a center of the head bolts positioned at either circumferential direction end of the head bolt group to the central axis, exists is set as a first region and a remaining angular range is set as a second region, a non-contact region in which contact is avoided between the piston and the cylinder head is provided within the second region.

Details as well as other features and advantages of this invention are set forth in the following description of the specification and illustrated in the attached figures.

DESCRIPTION OF THE PREFERRED EMBODIMENTS

Figure 1:
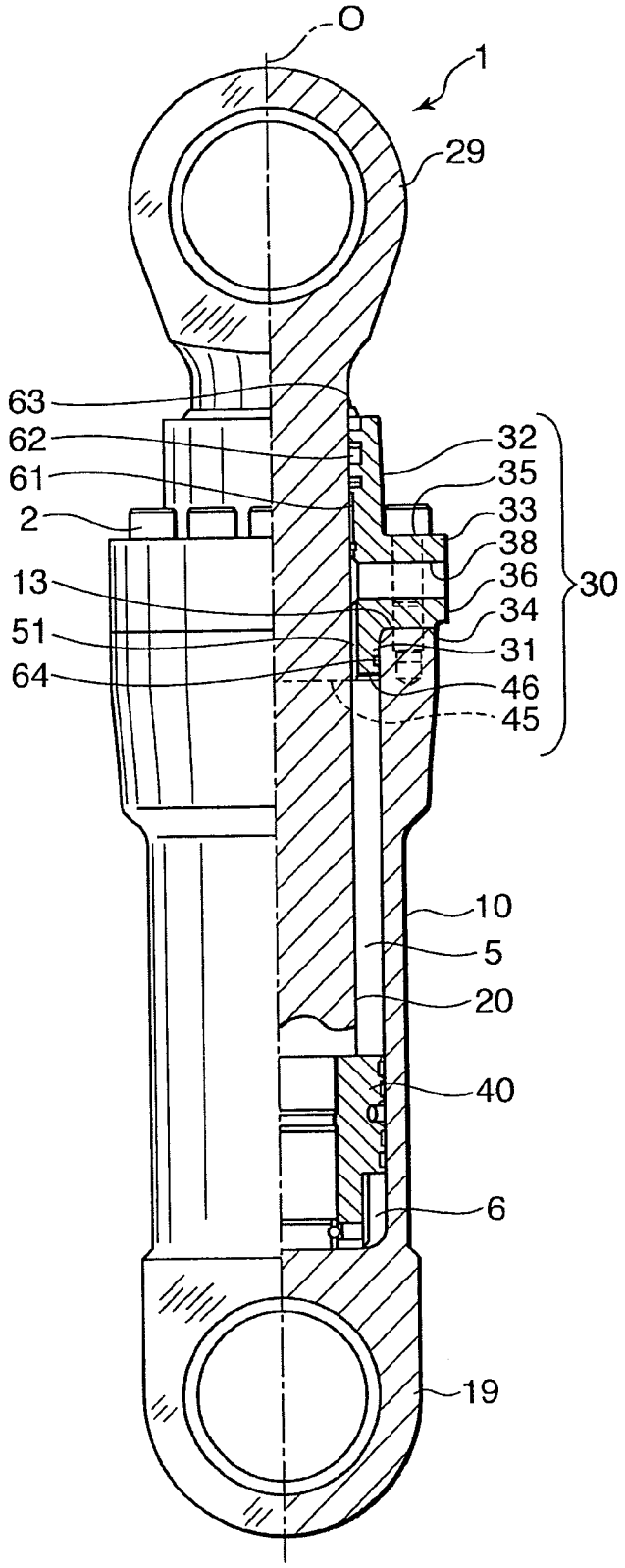
FIG. 1 is a composite diagram of a longitudinal sectional view and a side view of a fluid pressure cylinder according to an embodiment of this invention in a maximum contraction state.

Referring to FIG. 1 of the figures, a fluid pressure cylinder 1 is a linear actuator that expands and contracts in accordance with a working fluid pressure, and is interposed between a bucket and an arm of a power shovel, for example, in order to drive the bucket. It should be noted, however, that this invention is not limited to application as the fluid pressure cylinder 1. A working oil is preferably used as the working fluid of the fluid pressure cylinder 1, but a water-soluble replacement fluid may be used instead of a working oil.

The fluid pressure cylinder 1 comprises a tubular cylinder tube 10 that is open at one end and has a central axis O, a piston 40 that is accommodated inside the cylinder tube 10 to be cable of sliding in a direction of the central axis O, a columnar piston rod 20 that is joined to the piston 40 so as to project in an axial direction from the open end of the cylinder tube 10, and a cylinder head 30 that closes the open end while supporting the piston rod 20 to be free to slide.

An eye 19 is formed on a base end of the cylinder tube 10, which is positioned on an opposite side of the direction of the central axis O to the cylinder head 30. A similar eye 29 is formed on the projecting end of the piston rod 20. The fluid pressure cylinder 1 is interposed between the arm and the bucket of the power shovel using these eyes 19 and 29.

A fluid pressure chamber 5 on the periphery of the piston rod 20 and a fluid pressure chamber 6 on an opposite side of the piston rod 20 are defined inside the cylinder tube 10 by the piston 40. The fluid pressure chamber 5 and the fluid pressure chamber 6 are caused to enlarge and contract by a pressurized working fluid supplied selectively thereto through pipes from a fluid pressure supply source, and as a result, the piston rod 20 is caused to expand and contract via the piston 40.

The cylinder tube 10, the piston rod 20, the cylinder head 30, and the piston 40 are provided coaxially about the central axis O.

In the cylinder head 30, a sleeve-shaped insert 31 is fitted into an inner peripheral surface of the cylinder tube 10 and a similarly sleeve-shaped exposed portion 32 projects from the cylinder tube 10 in the direction of the central axis O. Further, a flange portion 33 that projects in a radial direction is provided between the insert 31 and the exposed portion 32. A ring-shaped seal member 64 is sandwiched between an outer peripheral surface of the insert 31 and the inner peripheral surface of the cylinder tube 10.

A ring-shaped bush 61, a main seal 62, and a dust seal 63, all of which contact the piston rod 20 slidingly, are disposed on an inner periphery of the exposed portion 32.

By causing the bush 61 to contact the outer peripheral surface of the piston rod 20 slidingly, the piston rod 20 is supported to be capable of sliding relative to the cylinder head 30. By causing the main seal 62 to contact the outer peripheral surface of the piston rod 20 slidingly, the working oil is prevented from flowing out of the cylinder tube 10. By causing the dust seal 63 to contact the outer peripheral surface of the piston rod 20 slidingly, dust is prevented from infiltrating the cylinder tube 10 from the outside.

The flange portion 33 includes an annular seat surface 34 that faces an end surface 13 of the cylinder tube 10 in the direction of the central axis O. When the insert 31 of the cylinder head 30 is inserted into the cylinder tube 10 such that the seat surface 34 contacts the end surface 13 of the cylinder tube 10, the cylinder head 30 is fixed to the cylinder tube 10 by head bolts 2.

The flange portion 33 is formed with a pipe attachment seat 36 having a port 38 for supplying the pressurized working oil to the fluid pressure chamber 5 on the periphery of the piston rod 20 or discharging the working oil from the fluid pressure chamber 5. A pipe is connected to the port 38 by fixing a joint to the pipe attachment seat 36. The port 38 communicates with the fluid pressure chamber 5 on the periphery of the piston rod 20 via a gap 51. The port 38 is formed about a radial line extending in the radial direction from the central axis O.

Figure 3:
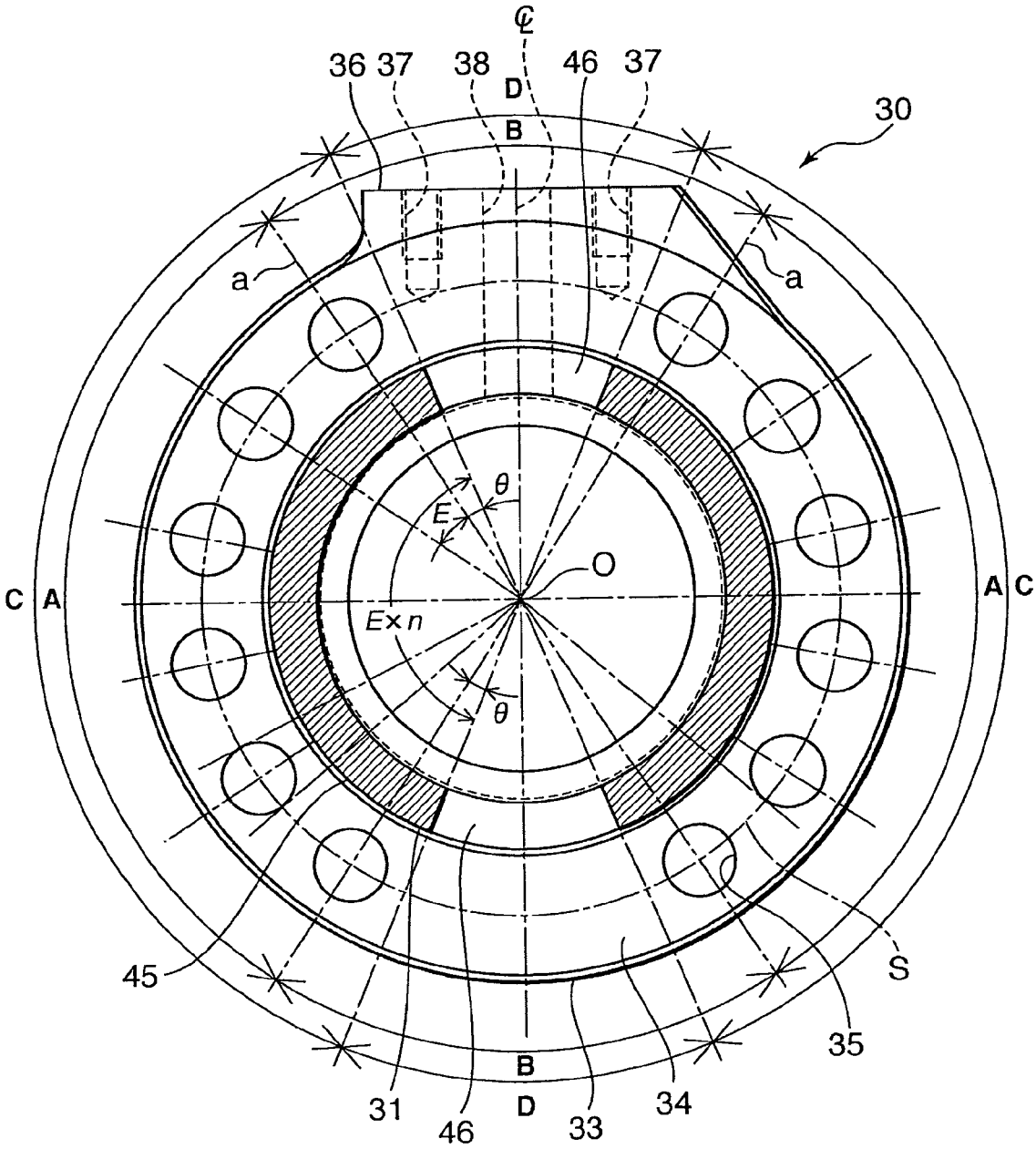
FIG. 3 is a plan view showing a cylinder head according to an embodiment of this invention from below.

Referring to FIG. 3, four screw holes 37 for fixing joints to either side of the port 38 are formed in the pipe attachment seat 36.

Although not shown in the figure, the fluid pressure chamber 6 on the opposite side of the piston rod 20 communicates with another pipe connected to the base portion of the cylinder tube 10 via a joint. The other pipe supplies the pressurized working fluid to the fluid pressure chamber 6 and discharges the working fluid from the fluid pressure chamber 6.

The cylinder head 30 is fastened to the cylinder tube 10 by twelve head bolts 2 penetrating head bolt holes 35 formed in the flange portion 33. Screw holes are formed in the cylinder tube 10 in positions corresponding to the head bolts 2. The head bolts 2 and the screw holes are disposed to avoid the pipe attachment seat 36.

During an operation of the power shovel, the fluid pressure cylinder 1 expands and contracts in accordance with a working fluid pressure supplied from the outside to the fluid pressure chamber 5 or the fluid pressure chamber 6. As a result, the bucket of the power shovel swings relative to the arm, and an excavation operation or the like is thus performed using the bucket.

Figure 2:
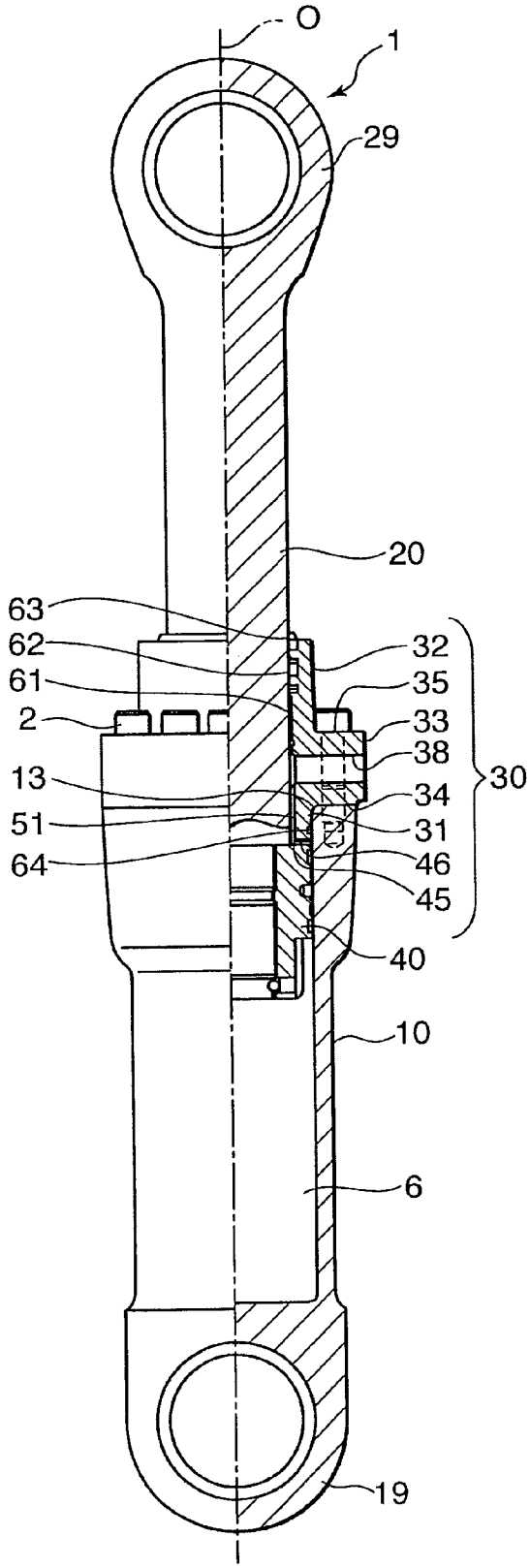
FIG. 2 is similar to FIG. 1 but shows the fluid pressure cylinder in a maximum expansion state.

When the fluid pressure cylinder is contracted, the pressurized working fluid is supplied to the fluid pressure chamber 5 from the pipe via the port 38. As a result, the piston 40 displaces downward in FIGS. 1 and 2 such that the piston rod 20 invades the cylinder tube 10. The working fluid in the contracted fluid pressure chamber 6 flows out into a tank through the other pipe connected to the base end of the cylinder tube 10.

When the fluid pressure cylinder 1 is driven to expand, the pressurized working fluid is supplied to the fluid pressure chamber 6. As a result, the piston 40 displaces upward in FIGS. 1 and 2 such that the piston rod 20 projects from the cylinder tube 10. The working fluid in the contracted fluid pressure chamber 5 flows out into the tank through the port 38 and the pipe connected to the port 38.

Referring again to FIG. 2, when the fluid pressure cylinder 1 expands to the extent that the piston 40 contacts a lower end 45 of the insert 31 of the cylinder head 30, the fluid pressure cylinder 1 reaches a maximum expansion state. In the maximum expansion state, a fluid pressure exerted on the piston 40 by the fluid pressure chamber 6 causes a tensile load to act on the twelve head bolts 2 fastening the cylinder head 30. Furthermore, when the bucket of the power shovel applies an expansion load to the fluid pressure cylinder 1 in this state, a larger tensile load acts on the head bolts 2.

To disperse this tensile load evenly among the twelve head bolts 2, a contact region and a non-contact region are formed in the fluid pressure cylinder 1 with respect to an arrangement of the head bolts 2 on a contact surface between the piston 40 and the lower end 45 of the insert 31.

Referring again to FIG. 3, when the cylinder head 30 is seen from below, a first region A and a second region B are set on the flange portion 33 with respect to the arrangement of the head bolts 2.

In the fluid pressure cylinder 1, interference must be avoided between the port 38 and the screw holes 37, and therefore the head bolt holes 35 penetrated by the head bolts 2 cannot be formed in positions corresponding to the pipe attachment seat 36 of the flange portion 33. Taking into account a load balance in a cross-section, the head bolt holes 35 are also not formed in a region positioned 180 degrees relative to this region.

Hence, six head bolt holes 35 that penetrate the flange portion 33 to reach the cylinder tube 10 are formed respectively in left and right regions of the figure, excluding the aforementioned regions, at equal angular intervals E on a circumference S centering on the central axis O.

The cylinder head 30 is fixed to the cylinder tube 10 by the six head bolts 2 penetrating the head bolt holes 35. As a result, a head bolt group constituted by six of the head bolts 2 is formed in two regions.

The aforementioned first region A is constituted by regions bordered by two lines a linking the centers of head bolt holes 35 positioned at either end of each head bolt group to the central axis O. The aforementioned second region B is constituted by two regions sandwiched between the two first regions A.

The number of head bolts 2 in each head bolt group is not limited to six. If the number of head bolts 2 is n, the first region takes an angular range of $(n-1)\times E$.

The first regions A are set to be symmetrical about a center line CL of the port 38 passing through the central axis O. The second regions B are set to include the center line CL of the port 38 passing through the central axis O and to be symmetrical about the center line CL.

Meanwhile, contact regions C and non-contact regions D formed on the contact surface between the piston 40 and the lower end 45 of the insert 31 are set as follows.

Boundary lines between the non-contact regions D and the contact regions C are set in positions rotated by an angle θ toward the center line CL from the boundary lines between the first regions A and the second regions B. Two regions including the center line CL sandwiched between the two boundary lines between the non-contact regions D and the contact regions C are set as the non-contact regions D, and the remaining regions are set as the contact regions C. The angle θ is preferably set at or below an angle E/2 such that an angular range of the contact region C is equal to or smaller than n×E in relation to the angular range (n−1)×E of the first region A.

As a result, the non-contact region D is formed inside the second region B in the circumferential direction. The contact region C includes the first region A and is set over a wider range than the first region A.

The contact region C is a region in which, when the fluid pressure cylinder 1 is in the maximum expansion state, the piston 40 contacts the lower end 45 of the insert 31 of the cylinder head 30. In the non-contact region D, the piston 40 does not contact the lower end 45 of the insert 31 of the cylinder head 30.

The contact region C and the non-contact region D are formed as follows. A recessed portion 46 is formed in an end surface of the lower end 45 of the cylinder head 30 corresponding to the non-contact region. Hence, when the fluid pressure cylinder 1 is in the maximum expansion state, the piston 40 contacts the lower end 45 of the insert 31 of the cylinder head 30 in the contact regions C but does not contact the lower end 45 of the insert 31 of the cylinder head 30 in the non-contact region D due to the recessed portion 46.

With the constitution described above, the tensile load acting on the cylinder head 30 is applied only to the contact regions C and not to the non-contact regions D when the fluid pressure cylinder 1 is in the maximum expansion state. As a result, the tensile load is transmitted evenly to the head bolts 2 positioned on an outer side of the contact regions C in the radial direction via the flange portion 33.

When the non-contact regions D are not provided, the tensile load is transmitted to the head bolts 2 from the entire circumference of the cylinder head 30. As a result, a larger tensile load acts on the head bolts 2 positioned on the respective ends of the head bolt groups than on the other head bolts 2, leading to a load bias among the head bolts 2.

In this fluid pressure cylinder 1, the non-contact region D is set on the inside of the second region B, and therefore the tensile load acting on the head bolts 2 positioned on the respective ends of the head bolt group can be suppressed to become equal to the tensile load acting on the other head bolts 2. By equalizing a tensile stress generated in each head bolt 12 in this manner, a maximum tensile strength required of the head bolts 2 can be reduced, and therefore head bolts 2 having a smaller diameter can be used. As a result, a favorable effect is obtained in terms of reducing the size of the cylinder head 30.

With respect to the above description, the contents of Tokugan 2009-196541 with a filing date of Aug. 27, 2009 in Japan are incorporated herein by reference.

This invention was described above through specific embodiments, but this invention is not limited to the above embodiments, and various amendments and modifications may be added to the embodiments by a person skilled in the art within the scope of the claims.

For example, in the above embodiment, the non-contact region D is set as a region having a smaller angular range than the second region B. However, the main object of this invention is to provide the non-contact region D within the second region B in order to lighten the tensile load acting on the head bolts 2 at the respective ends of the head bolt group, and therefore, as long as the non-contact region D exists within the second region B, equivalent preferable effects are obtained in a case where the non-contact region D has an equal angular range to the second region B or a case in which the non-contact region exists partly within the first region A, for example.

In the above embodiment, the recessed portion 46 for realizing the non-contact region D is formed in the end surface of the lower end 45 of the cylinder head 30, but the recessed portion 46 may be formed in an end surface of the piston 40 facing the lower end 45 of the cylinder head 30.

The fluid pressure cylinder 1 is interposed between the arm and the bucket of the power shovel using the eyes 19 and 29, and therefore relative rotation between the cylinder tube 10 and the piston 40 is restricted by the arm and the bucket. Accordingly, a relative rotation position between the cylinder head 30 and the piston 40 remains unvarying at all times such that even when the recessed portion 46 is formed in the end surface of the piston 40, the non-contact region D does not deviate in the circumferential direction from the position shown in FIG. 3.

In the above embodiment, the second region B and the non-contact region D are set in both the region including the pipe attachment seat 36 and the region positioned 180 degrees relative to this region. As described above, the regions are preferably set in this manner to maintain a favorable load balance in the cross-section. However, the only region in which the head bolts 2 cannot physically be disposed is the region including the pipe attachment seat 36, and therefore the head bolts 2 may be disposed in the region positioned 180 degrees relative to this region.

More specifically, the second region B and the non-contact region D may be set only in the region including the pipe attachment seat 36. In this case, only one head bolt group is required. Even when this constitution is employed, this invention brings about favorable effects in terms of lightening the tensile load acting on the head bolts 2 positioned at either end of the head bolt group such that the load of all of the head bolts 2 is equalized.

INDUSTRIAL APPLICABILITY

As described above, this invention is suitable for application to a fluid pressure cylinder employed in a construction machine such as a power shovel, but may be applied to another fluid pressure cylinder.

Exclusive properties or features encompassed by the embodiments of this invention are as claimed below.

The invention claimed is:

1. A fluid pressure cylinder comprising:

a cylinder tube having a central axis and an open end oriented in an axial direction;

a piston accommodated in the cylinder tube to be capable of sliding in the axial direction;

a piston rod that is joined to the piston and projects from the cylinder tube in the axial direction to an outer side of the cylinder tube;

a cylinder head that closes the open end while supporting the piston rod to be capable of sliding, the piston contacting the cylinder head in accordance with an axial direction displacement thereof; and a plurality of head bolts that fix the cylinder head to the open end of the cylinder tube, wherein the head bolts are disposed at equal angular intervals within a fixed angular range on a circumference centering on the central axis of the cylinder tube, thereby forming a head bolt group, and when an angular range in which the head bolt group, which is bordered by two straight lines linking a center of the head bolts positioned at either circumferential direction end of the head bolt group to the central axis, exists is set as a first region and a remaining angular range is set as a second region, a non-contact region in which contact is avoided between the piston and the cylinder head is provided within the second region.

2. The fluid pressure cylinder as defined in claim 1, wherein a contact region obtained by excluding the non-contact region from the first region and the second region is a region in which the piston contacts the cylinder head in accordance with the axial direction displacement of the piston, the contact region includes all of the first region, and the second region includes all of the non-contact region.

3. The fluid pressure cylinder as defined in claim 2, wherein an angular range of the contact region is set to be equal to or smaller than an angular range defined by a product of a number of the head bolts disposed in the first region and an angular interval.

4. The fluid pressure cylinder as defined in claim 1, wherein the cylinder head has an annular end surface that faces the piston, and the non-contact region is constituted by a recessed portion formed in the end surface to face the piston.

5. The fluid pressure cylinder as defined in claim 1, wherein the cylinder head includes a pipe attachment seat formed with a port for connecting an external pipe, and the second region is set in a region including the pipe attachment seat.

6. The fluid pressure cylinder as defined in claim 5, wherein the second region includes the region including the pipe attachment seat and a region positioned 180 degrees relative to the region including the pipe attachment seat.

* * * * *